US006779635B1

(12) United States Patent
Anibas

(10) Patent No.: US 6,779,635 B1
(45) Date of Patent: Aug. 24, 2004

(54) MECHANISM FOR PROVIDING MOTION AND FORCE WHILE MAINTAINING PARALLELISM BETWEEN A BASE STRUCTURE AND A MOVABLE STRUCTURE

(76) Inventor: Kevin J. Anibas, 2136 4th St., Eau Claire, WI (US) 54703

( * ) Notice: Subject to any disclaimer, the term of this patent is extended or adjusted under 35 U.S.C. 154(b) by 19 days.

(21) Appl. No.: 10/392,226

(22) Filed: Mar. 18, 2003

Related U.S. Application Data

(63) Continuation-in-part of application No. 09/822,083, filed on Apr. 2, 2001, now abandoned.

(51) Int. Cl.[7] ..... B66F 7/06; B66F 7/14

(52) U.S. Cl. ..... 187/269; 187/267; 187/211; 187/214; 254/122; 254/126

(58) Field of Search ..... 187/210, 211, 187/214, 267, 268, 269; 254/122, 126, 8 R, 10 R

(56) References Cited

U.S. PATENT DOCUMENTS

| | | | |
|---|---|---|---|
| 298,568 | A | 5/1884 | Fisher |
| 326,326 | A | 9/1885 | Perry |
| 383,035 | A | 5/1888 | Bell |
| 458,847 | A | 9/1891 | Hooker et al. |
| 740,398 | A | 10/1903 | Cheves |
| 780,933 | A | 1/1905 | Brown |
| 796,815 | A | 8/1905 | Coy |
| 918,240 | A | 4/1909 | Wheeler |
| 1,080,375 | A | 12/1913 | Senderling |
| 1,559,844 | A | 11/1925 | Brooks |
| 1,725,216 | A | 8/1929 | Seldombridge |
| 1,794,165 | A | 2/1931 | Gannaway |
| 1,903,905 | A | 4/1933 | Carter |
| 2,121,861 | A | 6/1938 | Dickerson |
| 2,206,788 | A | 7/1940 | Meacham |
| 2,358,501 | A | 9/1944 | Frova |
| 2,646,322 | A | 7/1953 | Laxo |
| 2,790,694 | A | 4/1957 | Palmer |
| 3,110,476 | A | 11/1963 | Farris |
| 3,237,921 | A | 3/1966 | Jay |
| 3,282,566 | A | 11/1966 | Clarke |
| 3,443,850 | A | 5/1969 | Scime et al. |
| 3,917,211 | A | 11/1975 | Daunderer et al. |
| 4,126,096 | A | 11/1978 | Malavard |
| 4,405,116 | A | 9/1983 | Eisenberg |
| 4,511,110 | A | 4/1985 | Moller |
| 4,616,887 | A | 10/1986 | Oudman |
| 4,638,610 | A | 1/1987 | Heillinen |
| 4,741,414 | A | 5/1988 | Claassen |
| 5,476,050 | A | 12/1995 | Zimmer et al. |
| 5,694,864 | A | 12/1997 | Langewellpott |
| 6,361,131 | B1 | 3/2002 | Powell, Jr. |

*Primary Examiner*—Eileen D. Lillis
*Assistant Examiner*—Thuy V. Tran
(74) *Attorney, Agent, or Firm*—Tipton L. Randall

(57) ABSTRACT

A mechanism is disclosed that provides motion and force while maintaining parallelism between a base structure and a movable structure. This is accomplished by opposed pairs of pivoting arm assemblies, which are synchronized by a timing device that links opposed pairs of pivoting arm assemblies to ensure that the arm assemblies move the same distance. The mechanism operates in any spatial orientation. Applications of the mechanism include lift tables, adjustable work stations, vertically adjustable conveyors, and others.

28 Claims, 3 Drawing Sheets

MECHANISM FOR PROVIDING MOTION AND FORCE WHILE MAINTAINING PARALLELISM BETWEEN A BASE STRUCTURE AND A MOVABLE STRUCTURE

CROSS-REFERENCE TO RELATED APPLICATIONS, IF ANY

This application is a continuation-in-part of utility application Ser. No. 09/822,083, filed 02 Apr. 2001, now abandoned. Application Ser. No. 09/822,083 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a device for raising and lowering items and, more particularly, to a mechanism for maintaining a parallel orientation between a base structure and a movable structure while varying the distance between the structures.

2. Background Information

This invention applies to maintaining parallelism between a base structure and a movable structure as it applies to lifting devices, lift tables, adjustable workstations, and other applications where maintaining parallelism is necessary.

Currently available lift tables are most commonly actuated by a scissor mechanism featuring arms which pivot with a mating arm in the center of their length. One end of these arms is rotatably fixed to either the top structure or the base structure of the lift, and the other end is free to move along a plane parallel to the base and the movable surface. Because of the central pivot point, large bending forces are introduced into said arms. To maintain strength and safety, these arms and structures related to them must be made of sufficient quantities of strong materials, usually steel, which results in considerable weight. These lifts suffer reduced capacity as a result of having to lift this weight in addition to the load. These lifts generally are limited in length, as the bending forces on the arms and the energy required to move the arms becomes impractically large at longer arm lengths. These lifts also are limited in terms of portability, because their mass makes them difficult to move. Also, due to this mass, these lifts need relatively larger actuation devices and more energy to operate. In some cases these devices can only operate vertically because they rely on gravity to maintain parallelism between the base and the movable structure.

Applicant has devised a mechanism for maintaining a parallel orientation between a base structure and a movable structure, while varying the distance between the structures.

SUMMARY OF THE INVENTION

The invention is a mechanism for maintaining parallel orientation between a base structure and a moveable structure. The mechanism includes a pair of opposed arm assemblies, each assembly adapted for rotatable attachment at one end to the base structure and adapted for rotatable attachment at an opposite end to the moveable structure. Each arm assembly includes at least one pair of arm members, each at least one pair of arm members pivotally mounted at one arm member end to a center shaft member, with one arm member of each at least one pair rigidly secured to a first support shaft member at an end opposite the center shaft member and another arm member of each at least one pair rigidly secured to a second support shaft member at an end opposite the center shaft member. The first support shaft member is adapted for rotatable attachment to the moveable structure, and the second support shaft member is adapted for rotatable attachment to the base structure. An actuating means for effecting movement between the center shaft members of the pair of opposed arm assemblies is present. A first mechanical timing mechanism operatively connects the first support shaft members, the first timing mechanism effecting equal and opposite rotation between the first support shaft members of the opposed arm assemblies, and a second mechanical timing mechanism operatively connects the second support shaft members, the second timing mechanism effecting equal and opposite rotation between the second support shaft members of the opposed arm assemblies. The mechanism maintains parallel orientation between the base structure and the moveable structure. In a preferred embodiment of the mechanism invention, each arm assembly includes two pairs of arm members.

In another embodiment of the invention, a lifting system for level movement is disclosed. The lifting system includes a base structure and a moveable structure, with the structures positioned in register with each other. A pair of opposed arm assemblies are positioned between the base structure and the moveable structure, with each assembly rotatably secured at one end to the base structure and rotatably secured at an opposite end to the moveable structure. Each arm assembly includes at least one pair of arm members, with each at least one pair of arm members pivotally mounted at one arm member end to a center shaft member. One arm member of each at least one pair is rigidly secured to a first support shaft member at an end opposite the center shaft member, and another arm member of each at least one pair is rigidly secured to a second support shaft member at an end opposite the center shaft member. The first support shaft member is rotatably secured to the moveable structure, and the second support shaft member is rotatably secured to the base structure. An actuating means is present for effecting movement between the center shaft members of the pair of opposed arm assemblies. A first mechanical timing mechanism operatively connects the first support shaft members, the first timing mechanism effecting equal and opposite rotation between the first support shaft members of the opposed arm assemblies, and a second mechanical timing mechanism operatively connects the second support shaft members, the second timing mechanism effecting equal and opposite rotation between the second support shaft members of the opposed arm assemblies, thereby providing parallel movement between the base structure and the moveable structure. In a preferred embodiment of the lifting system invention, each arm assembly includes two pairs of arm members.

DESCRIPTION OF THE EMBODIMENTS

Nomenclature

1 Base Structure
2 Moveable Structure
3 Arm Assemblies
4 Arm Members
5 Sprocket Members
6 Chain Section
7 Tension Members
8 Tensioning Device
9 Actuation Device
10 Screw Shaft
11 Hand Crank
12 Nut
15 Center Shaft Members
20 First Support Shaft Member
22 Second Support Shaft Member
25 Bracket Members
30 Mechanical Timing Linkage
35 Chain and Tensioning Unit
40 Gear Belt and Tensioning Unit
45 Gear Member
50 Gear Belt Section
55 Pulley and Cable Tensioning Unit
60 Pulley Member
65 Cable Member
70 Cable and Tensioning Unit Construction Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

The invention is a mechanism that includes a pair of opposed arm assemblies, each assembly adapted for rotatable attachment at one end to the base structure and adapted for rotatable attachment at an opposite end to the moveable structure. Each arm assembly includes at least one pair of arm members, each at least one pair of arm members pivotally mounted at one arm member end to a center shaft member. One arm member of each at least one pair is rigidly secured to a first support shaft member at an end opposite the center shaft member and another arm member of each at least one pair is rigidly secured to a second support shaft member at an end opposite the center shaft member. The first support shaft member is adapted for rotatable attachment to the moveable structure, and the second support shaft member is adapted for rotatable attachment to the base structure. An actuating means effects movement between the center shaft members of the pair of opposed arm assemblies. A first mechanical timing mechanism operatively connects the first support shaft members, the first timing mechanism effecting equal and opposite rotation between the first support shaft members of the opposed arm assemblies, and a second mechanical timing mechanism operatively connects the second support shaft members, the second timing mechanism effecting equal and opposite rotation between the second support shaft members of the opposed arm assemblies. The mechanism maintains parallel orientation between the base structure and the moveable structure.

In a preferred embodiment of the mechanism invention, each arm assembly includes two pairs of arm members. The preferred embodiment of the mechanism invention including two pairs of arm members in each arm assembly is described below. The embodiment of the mechanism invention that includes one pair of arm members in each arm assembly functions on the same principles as described for the embodiment including two pairs of arm members in each arm assembly.

Figure 5:
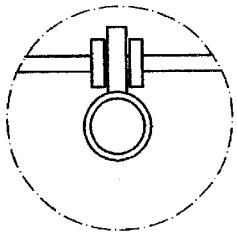
FIG. 5 shows an enlarged view of the rotatable and pivotable screw shaft to arm assembly pivot mount.
Figure 6:
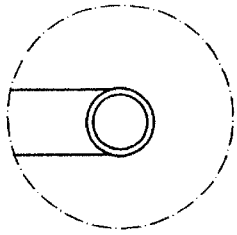
FIG. 6 shows an enlarged view of the pivotable nut assembly to arm assembly pivot mount.
Figure 4:
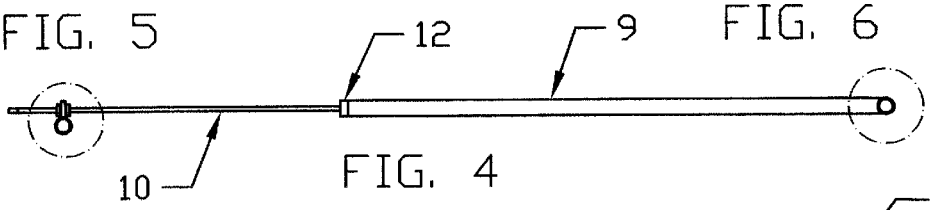
FIG. 4 shows a side view of the screw shaft and nut actuator assembly in an extended position.
Figure 7:
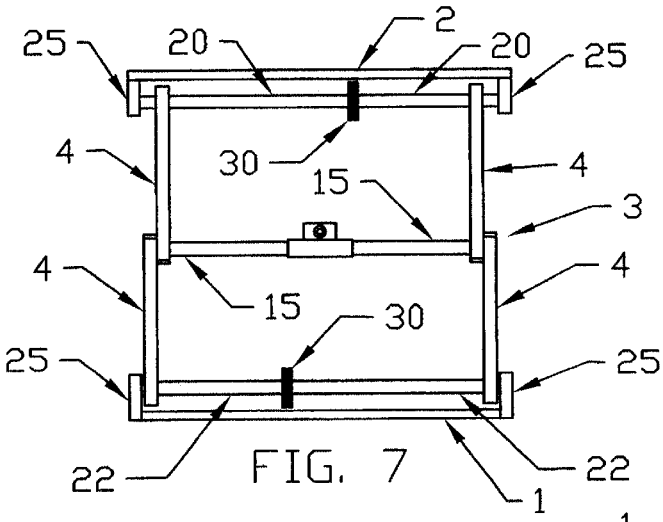
FIG. 7 shows an end view of the mechanism.

The mechanism of the preferred embodiment of the present invention is positioned between a base structure 1 and a movable structure 2 and provides relative movement between the structures 1, 2. The mechanism comprises two opposed arm assemblies 3, a mechanical timing mechanism (FIGS. 1 and 2), and an actuation device 9 (FIGS. 4–6). The two opposed arm assemblies 3 each consist of two pairs of arm members 4. The arm members 4 of each pair are pivotally mounted to each other at one arm member end by a common center shaft member 15, with each pair of arm members 4 positioned at opposite ends of the center shaft member 15. The arm member ends opposite the center shaft member 15 are rigidly connected to first and second support shaft members 20, 22. The first support shaft member 20 is secured between one arm member end of each arm pair on the center shaft members 15, and the second support shaft member 22 is secured between the other arm member end of each arm pair on the center shaft members 15, as illustrated in FIG. 7. Preferably, the arm members 4 are of equal length and the arm members 4 of each pair secured to a given support shaft member are aligned or in register with each other.

Each of the arm assemblies 3 is rotatably mounted to the base structure 1 at one end of the arm assembly 3 and rotatably mounted to the moveable structure 2 at the other end of the arm assembly 3. The rotatable mounting is achieved by, for example, brackets 25 rigidly secured to the base structure 1 or to the moveable structure 2, with the support shaft members 20, 22 rotatably mounted in the brackets 25 by, for example, bearings or bushings (not shown). The brackets 25 are preferably positioned on the support shaft members 20, 22 exterior the arm member ends.

Figure 8:
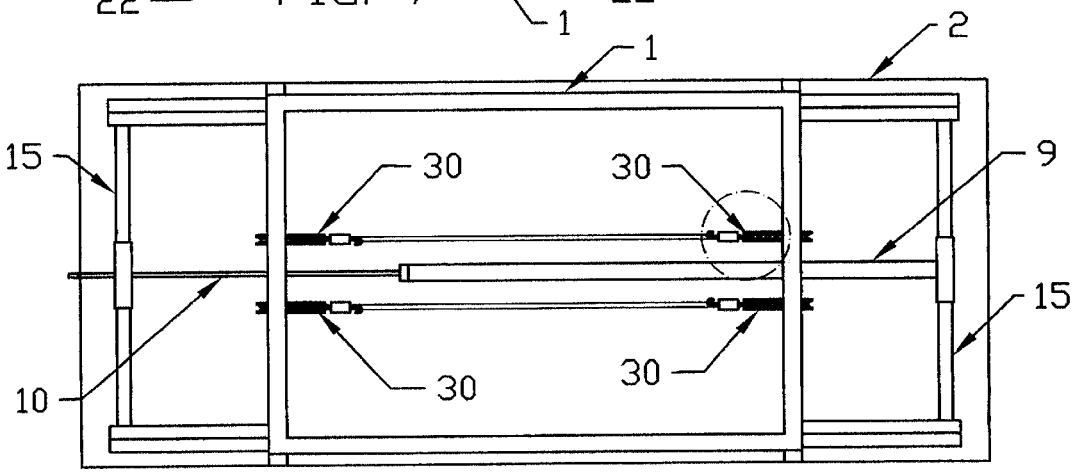
FIG. 8 shows a bottom view of the mechanism.
Figure 12:
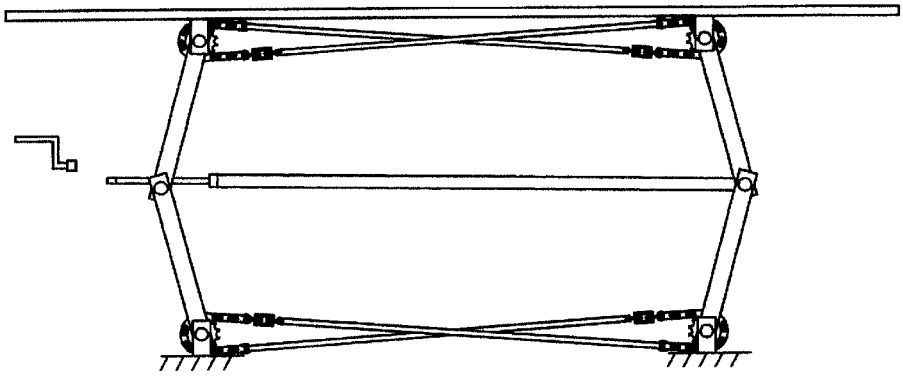
FIG. 12 shows a side view of the mechanism in an extended position with an immobile base structure.

In order to effect movement between the base structure 1 and the moveable structure 2, the mechanism is actuated by moving the opposed center shaft members 15 of the arm assemblies 3 toward or away from each other. This movement is accomplished by means of an actuation device 9 that has a screw shaft 10, which is rotationally and pivotably mounted to the center shaft member 15 on one arm assembly 3 (FIG. 5), acting on a mating nut assembly 12, which is pivotally mounted to a center shaft member 15 of the other arm assembly 3 (FIG. 6). Since the nut 12 is located on the end of the actuation assembly 9, the screw shaft 10 need not extend the full length from one arm assembly pivot to the other arm assembly pivot. As the screw shaft 10 is turned, the arm assembly to arm assembly pivot points on the center shaft members 15 are pulled toward one another, and the movable structure 2 is moved away from the base structure 1 while remaining parallel to the base structure 1. Likewise, when the screw shaft 10 is turned the other direction, the arm assembly to arm assembly pivot points on the center shaft members 15 are moved away from each other, and the movable structure 2 is moved toward the base structure 1, while remaining parallel to the base structure 1. The screw shaft 10 is turned with a hand crank 11, a hand held drill (not shown), or by a motor mounted on the arm assembly pivot (not shown). Alternatively, a pneumatic or hydraulic cylinder (not shown) or a cable and winch (not shown) can be used as an actuation device 9 in place of the screw shaft 10. Although the base structure 1 is shown as a rectangular frame in FIG. 8, the base structure 1 may comprise any rigid support surface, including a building floor or foundation, as illustrated in FIG. 12. For such an embodiment, the brackets 25 rotatably holding the second support shaft members 22 are secured directly to the floor or foundation. Thus, the base structure 1 and attached mechanism can be either transportable or immobile.

Figure 1:
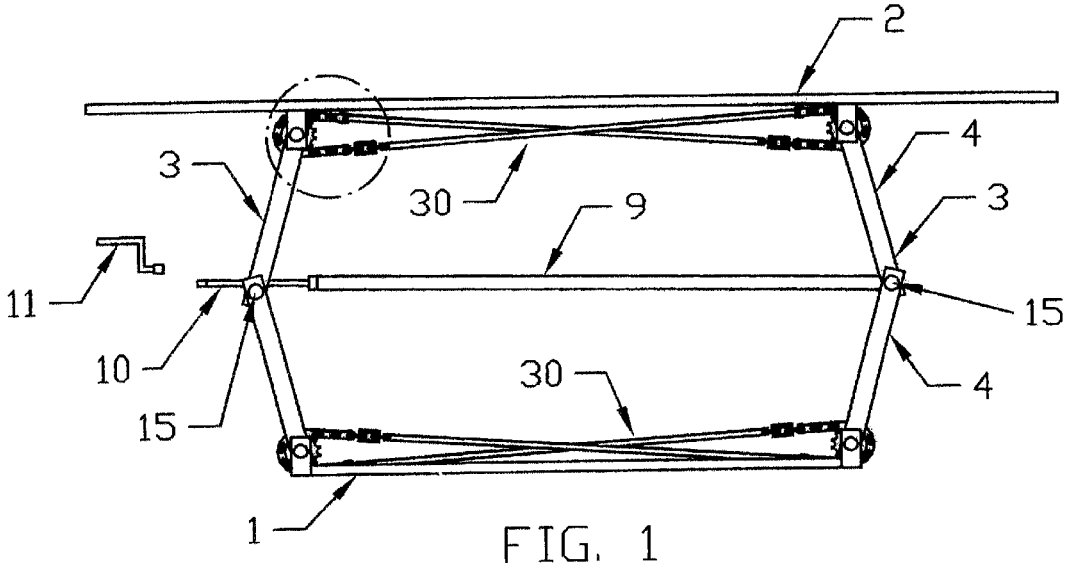
FIG. 1 shows a side view of the mechanism in an extended position.
Figure 3:
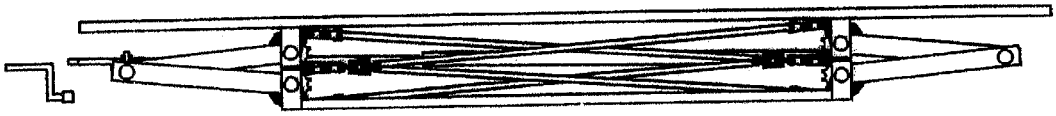
FIG. 3 shows a side view of the mechanism in a retracted position.

In order to maintain a parallel orientation between the base structure 1 and the moveable structure 2, a first mechanical timing linkage 30 connects the first support shaft members 20 of the arm assemblies 3, and a second mechanical timing linkage 30 connects the second support shaft members 22 of the arm assemblies 3. In one embodiment of the invention, a sprocket member 5 is rigidly fixed to each of the support shaft members 20, 22 between the rigidly connected arm members 4. A chain and tensioning unit 35 connects the sprocket member 5 of the first support shaft members 20, and another chain and tensioning unit 35 connects the sprocket member 5 of the second support shaft members 22. A section of chain 6 is fitted over each of the sprocket members 5. As illustrated in FIG. 1, the sections of chain 6 on the sprocket members 5 of the first support shaft member 20 are joined in cross fashion by tension members 7 of sufficient strength to accommodate the expected loads, including a factor of safety. Slack is removed from the mechanical timing linkage 30 by the incorporation of an in-line turnbuckle 8 or other tensioning devices. Likewise, the sections of chain 6 on the sprocket members 5 of the second support shaft members 22 are joined in cross fashion by tension members 7 of sufficient strength to accommodate the expected loads, including a factor of safety. Slack is removed from the mechanical timing linkage 30 by the incorporation of an in-line turnbuckle 8 or other tensioning devices. Alternatively, gear belts and pulleys, notched pulleys and cables or the like, can be substituted for the sprocket members 5 and the chain and tensioning units 35 with equivalent results.

In operation of the mechanism, movement of the center shaft members 15 relative to each other by the actuation device 9 causes the arm members 4 to pivot and the rigidly attached support shaft members 20, 22 to rotate within the brackets 25. The first support shaft members 20 of the arm assemblies 3 each rotate in opposite directions, one clockwise and the other counter clockwise. Likewise, the second support shaft members 22 of the arm assemblies 3 each rotate in opposite directions. Because the sprocket members 5, chains 6 and tensioning members 7 link the first support shaft members 20 to each other in a cross fashion and link the second support shaft members 22 to each other in a cross fashion, the support shaft members 20, 22 and attached arm members 4 must move equal distances and in opposite directions. Thus, the attachment points for the arm assemblies 3 on the moveable structure 2 moves toward or away from the base structure 1 an equal distance, and the moveable structure 2 is maintained in a parallel orientation with the base structure 1.

Figure 2:
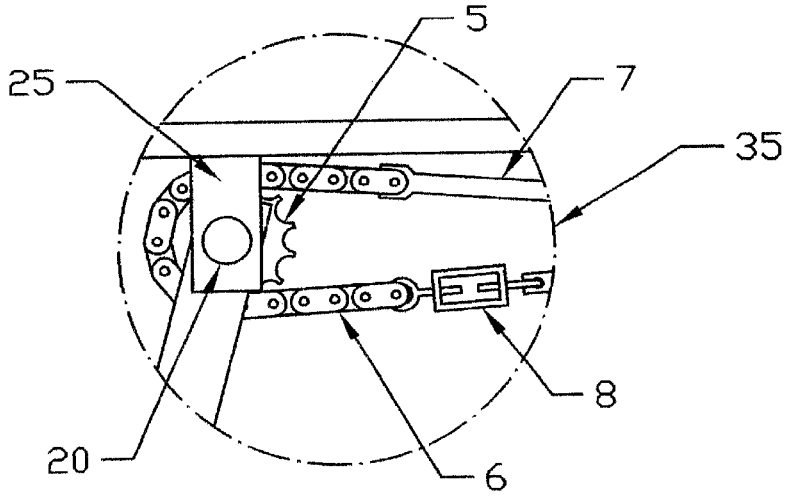
FIG. 2 shows an enlarged view of a sprocket fixed to a rotatably mounted arm assembly, a chain segment, tension members, and a tensioning device, as seen from the side.
Figure 9:
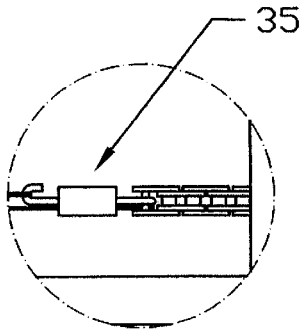
FIG. 9 shows an enlarged view of a tensioner, tension members and chain, as seen from the bottom.
Figure 10:
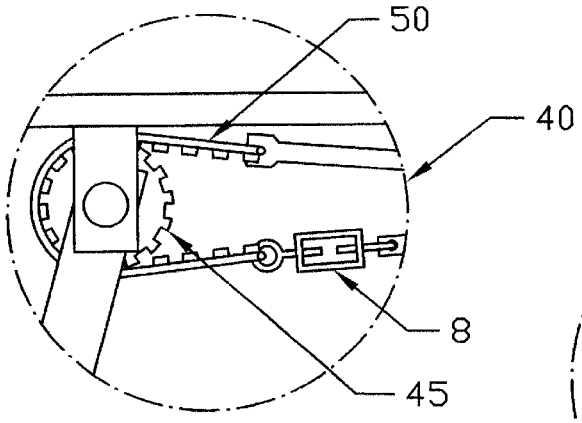
FIG. 10 shows an enlarged view of a gear fixed to a rotatably mounted arm assembly, a gear belt segment, tension members, and a tensioning device, as seen from the side.

Although the mechanical timing linkages 30 between the pairs of support shaft members 20, 22 are shown in FIGS. 2 and 9 as made of sprocket members 5, chains 6 and tension members 7, other mechanical timing linkages 30 can be employed with equivalent results. Referring now to FIG. 10, the mechanical timing linkages 30 includes a gear belt and tensioning unit 40 composed of a gear member 45 rigidly fixed to each of the support shaft members 20, 22 between the rigidly connected arm members 4. A gear belt and tensioning unit 40 connects the gear member 45 of the first support shaft members 20 in a cross fashion, and another gear belt and tensioning unit 40 connects the gear member 45 of the second support shaft members 22 in a cross fashion. A section of gear belt 50 is fitted over each of the gear members 45 and a tensioning device 8 adjusts the overall length of the gear belt and tensioning unit 40.

Figure 11:
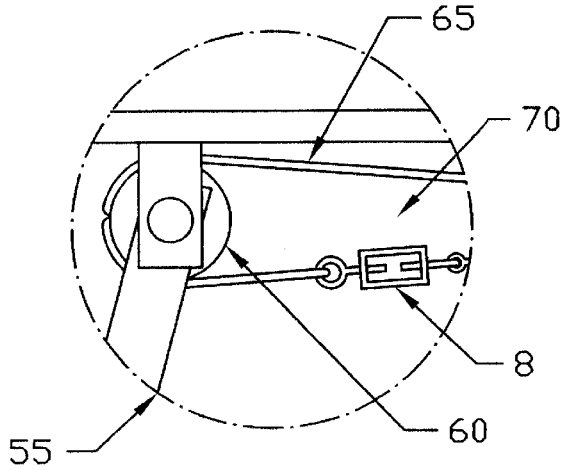
FIG. 11 shows an enlarged view of a pulley fixed to a rotatably mounted arm assembly, cable segments, and a tensioning device, as seen from the side.

Referring now to FIG. 11, another embodiment of the mechanical timing linkages 30 is shown. In this embodiment, the mechanical timing linkages 30 includes a pulley and cable tensioning unit 55 composed of a pulley member 60 rigidly fixed to each of the support shaft members 20, 22 between the rigidly connected arm members 4. A cable and tensioning unit 70 connects the pulley members 60 of the first support shaft members 20 in a cross fashion, and another cable and tensioning unit 70 connects the pulley members 60 of the second support shaft members 22 in a cross fashion. Unlike the sprocket chain sections 6 and the gear belt sections 50 of the timing linkages 30, the cable members 65 are necessarily anchored to each pulley member 60 to prevent slippage between the cable members 65 and the pulley members 60 during operation. Because the arm members 4, the attached support shaft members 20, 22 and the rigidly attached pulley members 60 rotate through, at most, a 90 degree arc between a collapsed and extended condition for the mechanism, the anchor points on the pulley members 60 for the cable members 65 are positioned to provide sufficient lengths of cable member 65 for the maximum rotation encountered. Again, a tensioning device 8, such as a turnbuckle, adjusts the overall length of the cable and tension unit 70.

While the invention has been particularly shown and described with reference to preferred embodiments thereof, it will be understood by those skilled in the art that various changes in form and details may be made therein without departing from the spirit and scope of the invention.

I claim:

1. A mechanism for maintaining parallel orientation between a base structure and a moveable structure including;

(a) a pair of opposed arm assemblies, each assembly adapted for rotatable attachment at one end to the base structure and adapted for rotatable attachment at an opposite end to the moveable structure;

(b) each arm assembly including at least one pair of arm members, each at least one pair of arm members pivotally mounted at one arm member end to a center shaft member, one arm member of each at least one pair rigidly secured to a first support shaft member at an end opposite the center shaft member and another arm member of each at least one pair rigidly secured to a second support shaft member at an end opposite the center shaft member;

(c) the first support shaft member adapted for rotatable attachment to the moveable structure and the second support shaft member adapted for rotatable attachment to the base structure;

(d) actuating means for effecting movement between the center shaft members of the pair of opposed arm assemblies; and (e) a first mechanical timing mechanism operatively connecting the first support shaft members, the first timing mechanism effecting equal and opposite rotation between the first support shaft members of the opposed arm assemblies and a second mechanical timing mechanism operatively connecting the second support shaft members, the second timing mechanism effecting equal and opposite rotation between the second support shaft members of the opposed arm assemblies, thereby maintaining parallel orientation between the base structure and the moveable structure.

2. The mechanism for maintaining parallel orientation between a base structure and a moveable structure according to claim 1, wherein each arm assembly includes two pairs of arm members.

3. The mechanism for maintaining parallel orientation between a base structure and a moveable structure according to claim 1, wherein the arm members are of essentially equal length.

4. The mechanism for maintaining parallel orientation between a base structure and a moveable structure according to claim 1, wherein the first support shaft members are adapted for rotatable attachment to the moveable structure by brackets rigidly secured to the moveable structure and the second support shaft members are adapted for rotatable attachment to the base structure by brackets rigidly secured to the base structure.

5. The mechanism for maintaining parallel orientation between a base structure and a moveable structure according to claim 1, wherein the actuating means includes a screw shaft rotationally and pivotally mounted on one center shaft member, the screw shaft engaging a mating nut assembly pivotally mounted on the other center shaft member.

6. The mechanism for maintaining parallel orientation between a base structure and a moveable structure according to claim 1, wherein the mechanical timing mechanisms includes a sprocket member rigidly fixed to each support shaft member, a chain and tensioning unit encircling the sprocket members of the first support shaft members in a cross fashion to effect equal and opposite rotation between the first support shaft members and a chain and tensioning unit encircling the sprocket members of the second support shaft members in a cross fashion to effect equal and opposite rotation between the second support shaft members.

7. The mechanism for maintaining parallel orientation between a base structure and a moveable structure according to claim 6, wherein the chain and tensioning units each include an inline turnbuckle member for removing slack from the chain and tensioning units.

8. The mechanism for maintaining parallel orientation between a base structure and a moveable structure according to claim 1, wherein the mechanical timing mechanisms include a gear member rigidly fixed to each support shaft member, a gear belt and tensioning unit encircling the gear members of the first support shaft members in a cross fashion to effect equal and opposite rotation between the first support shaft members and a gear belt and tensioning unit encircling the gear members of the second support shaft members in a cross fashion to effect equal and opposite rotation between the second support shaft members.

9. The mechanism for maintaining parallel orientation between a base structure and a moveable structure according to claim 1, wherein the mechanical timing mechanisms include a pulley member rigidly fixed to each support shaft member, a cable and tensioning unit encircling and anchored to the pulley members of the first support shaft members in a cross fashion to effect equal and opposite rotation between the first support shaft members and a cable and tensioning unit encircling and anchored to the pulley members of the second support shaft members in a cross fashion to effect equal and opposite rotation between the second support shaft members.

10. A mechanism for maintaining parallel orientation between a base structure and a moveable structure including;

(a) a pair of opposed arm assemblies, each assembly adapted for rotatable attachment at one end to the base structure and adapted for rotatable attachment at an opposite end to the moveable structure;

(b) each arm assembly including two pairs of arm members, each pair of arm members pivotally mounted at one arm member end to a center shaft member, one arm member of each pair rigidly secured to a first support shaft member at an end opposite the center shaft member and another arm member of each pair rigidly secured to a second support shaft member at an end opposite the center shaft member;

(c) the first support shaft member adapted for rotatable attachment to the moveable structure and the second support shaft member adapted for rotatable attachment to the base structure;

(d) actuating means for effecting movement between the center shaft members of the pair of opposed arm assemblies; and (e) a first mechanical timing mechanism operatively connecting the first support shaft members, the first timing mechanism effecting equal and opposite rotation between the first support shaft members of the opposed arm assemblies and a second mechanical timing mechanism operatively connecting the second support shaft members, the second timing mechanism effecting equal and opposite rotation between the second support shaft members of the opposed arm assemblies, thereby maintaining parallel orientation between the base structure and the moveable structure.

11. The mechanism for maintaining parallel orientation between a base structure and a moveable structure according to claim 10, wherein the arm members are of essentially equal length.

12. The mechanism for maintaining parallel orientation between a base structure and a moveable structure according to claim 10, wherein the first support shaft members are adapted for rotatable attachment to the moveable structure by brackets rigidly secured to the moveable structure and the second support shaft members are adapted for rotatable attachment to the base structure by brackets rigidly secured to the base structure.

13. The mechanism for maintaining parallel orientation between a base structure and a moveable structure according to claim 10, wherein the actuating means includes a screw shaft rotationally and pivotally mounted on one center shaft member, the screw shaft engaging a mating nut assembly pivotally mounted on the other center shaft member.

14. The mechanism for maintaining parallel orientation between a base structure and a moveable structure according to claim 10, wherein the mechanical timing mechanisms include a sprocket member rigidly fixed to each support shaft member, a chain and tensioning unit encircling the sprocket members of the first support shaft members in a cross fashion to effect equal and opposite rotation between the first support shaft members and a chain and tensioning unit encircling the sprocket members of the second support shaft members in a cross fashion to effect equal and opposite rotation between the second support shaft members.

15. The mechanism for maintaining parallel orientation between a base structure and a moveable structure according to claim 14, wherein the chain and tensioning unit includes an inline turnbuckle member for removing slack from the chain and tensioning unit.

16. The mechanism for maintaining parallel orientation between a base structure and a moveable structure according to claim 10, wherein the mechanical timing mechanisms include a gear member rigidly fixed to each support shaft member, a gear belt and tensioning unit encircling the gear members of the first support shaft members in a cross fashion to effect equal and opposite rotation between the first support shaft members and a gear belt and tensioning unit encircling the gear members of the second support shaft members in a cross fashion to effect equal and opposite rotation between the second support shaft members.

17. The mechanism for maintaining parallel orientation between a base structure and a moveable structure according to claim 10, wherein the mechanical timing mechanisms include a pulley member rigidly fixed to each support shaft member, a cable and tensioning unit encircling and anchored to the pulley members of the first support shaft members in a cross fashion to effect equal and opposite rotation between the first support shaft members and a cable and tensioning unit encircling and anchored to the pulley members of the second support shaft members in a cross fashion to effect equal and opposite rotation between the second support shaft members.

18. A lifting system for level movement including;

(a) a base structure and a moveable structure, the structures positioned in register with each other;

(b) a pair of opposed arm assemblies, positioned between the base structure and the moveable structure, each assembly rotatably secured at one end to the base structure and rotatably secured at an opposite end to the moveable structure;

(c) each arm assembly including at least one pair of arm members, each at least one pair of arm members pivotally mounted at one arm member end to a center shaft member, one arm member of each at least one pair rigidly secured to a first support shaft member at an end opposite the center shaft member and another arm member of each at least one pair rigidly secured to a second support shaft member at an end opposite the center shaft member;

(d) the first support shaft member rotatably secured to the moveable structure and the second support shaft member rotatably secured to the support structure;

(e) actuating means for effecting movement between the center shaft members of the pair of opposed arm assemblies; and (f) a first mechanical timing mechanism operatively connecting the first support shaft members, the first timing mechanism effecting equal and opposite rotation between the first support shaft members of the opposed arm assemblies and a second mechanical timing mechanism operatively connecting the second support shaft members, the second timing mechanism effecting equal and opposite rotation between the second support shaft members of the opposed arm assemblies, thereby providing parallel movement between the base structure and the moveable structure.

19. The lifting system for level movement according to claim 18, wherein each arm assembly includes two pairs of arm members.

20. The lifting system for level movement according to claim 18, wherein the base structure is a transportable unit.

21. The lifting system for level movement according to claim 18, wherein the base structure is an immobile unit.

22. The lifting system for level movement according to claim 18, wherein the arm members are of essentially equal length.

23. The lifting system for level movement according to claim 22, wherein the chain and tensioning unit includes an inline turnbuckle member for removing slack from the chain and tensioning unit.

24. The lifting system for level movement according to claim 18, wherein the actuating means includes a screw shaft rotationally and pivotally mounted on one center shaft member, the screw shaft engaging a mating nut assembly pivotally mounted on the other center shaft member.

25. The lifting system for level movement according to claim 18, wherein the mechanical timing mechanisms include a sprocket member rigidly fixed to each support shaft member, a chain and tensioning unit encircling the sprocket members of the first support shaft members in a cross fashion to effect equal and opposite rotation between the first support shaft members and a chain and tensioning unit encircling the sprocket members of the second support shaft members in a cross fashion to effect equal and opposite rotation between the second support shaft members.

26. The lifting system for level movement according to claim 18, wherein the first support shaft members are rotatably attached to the moveable structure by brackets rigidly secured to the moveable structure and the second support shaft members are rotatably attached to the base structure by brackets rigidly secured to the base structure.

27. The lifting system for level movement according to claim 18, wherein the mechanical timing mechanisms include a gear member rigidly fixed to each support shaft member, a gear belt and tensioning unit encircling the gear members of the first support shaft members in a cross fashion to effect equal and opposite rotation between the first support shaft members and a gear belt and tensioning unit encircling the gear members of the second support shaft members in a cross fashion to effect equal and opposite rotation between the second support shaft members.

28. The lifting system for level movement according to claim 18, wherein the mechanical timing mechanisms include a pulley member rigidly fixed to each support shaft member, a cable and tensioning unit encircling and anchored to the pulley members of the first support shaft members in a cross fashion to effect equal and opposite rotation between the first support shaft members and a cable and tensioning unit encircling and anchored to the pulley members of the second support shaft members in a cross fashion to effect equal and opposite rotation between the second support shaft members.

* * * * *